United States Patent [19]

Deutsch

[11] 4,450,746

[45] May 29, 1984

[54] FLUTE CHORUS GENERATOR FOR A POLYPHONIC TONE SYNTHESIZER

[75] Inventor: Ralph Deutsch, Sherman Oaks, Calif.

[73] Assignee: Kawai Musical Instrument Mfg. Co., Ltd., Hamamatsu, Japan

[21] Appl. No.: 411,159

[22] Filed: Aug. 24, 1982

[51] Int. Cl.[3] ..... G10H 1/02

[52] U.S. Cl. ..... 84/1.24; 84/1.22; 84/DIG. 4

[58] Field of Search ..... 84/1.01, 1.03, 1.19, 84/1.21, 1.22, 1.23, 1.24, DIG. 4

[56] References Cited

U.S. PATENT DOCUMENTS 4,192,210 3/1980 Deutsch ..... 84/1.01

4,211,138 7/1980 Deutsch ..... 84/1.01

4,286,491 9/1981 Deutsch ..... 84/1.22 X

*Primary Examiner*—Forester W. Isen

*Attorney, Agent, or Firm*—Ralph Deutsch

[57] ABSTRACT

A keyboard operated electronic musical instrument in which a number of tone generators are assigned to actuated keyswitches in which a flute chorus of similar tones at preselected pitch footages are generated by implementing a discrete Fourier transform employing a selected sequence of harmonic coefficients. Two stored harmonic coefficients suffice to generate a tibia type flute chorus. A harmonic sequence select logic in cooperation with signals derived from actuated tone switches provide the selected sequences of harmonic coefficients.

10 Claims, 18 Drawing Figures

16-FOOT

8-FOOT 5 1/3-FOOT

4-FOOT 2 2/3-FOOT

FUNDAMENTAL PITCHES

TOTAL FLUTE SPECTRA 2
4
6
8
10
12
14

ACCUMULATOR AND MEMORY ADDRESS
157
MEMORY ADDRESS DECODER
156
HARMONIC COUNTER
20
EXECUTIVE CONTROL
155
SWITCHES AND ASSIGNOR
154
WORD COUNTER
19
MAIN REGISTER
34
TONE GENERATORS
152
DATA CONVERTER AND SOUND SYSTEM
153
SINUSOID TABLE
24
ADDER
33
MULTIPLIER
28
ADDER
114
FULL HARMONIC COEFFICIENT
112
FRACTION HARMONIC COEFFICIENT
113
1
2
3
4
6
9
12
101
102
103
104
105
106
107
108
109
110
111
S1
S2
S3
S4
S5
16'
8'
5 1/3'
4'
2 2/3'

16-FOOT

8-FOOT 5 1/3-FOOT

4-FOOT 2 2/3-FOOT

FUNDAMENTAL PITCHES

TOTAL FLUTE SPECTRA 2
4
6
8
10
12
14

FLUTE CHORUS GENERATOR FOR A POLYPHONIC TONE SYNTHESIZER

BACKGROUND OF THE INVENTION

1. Field of the Invention

This invention relates to electronic musical tone synthesis and in particular is concerned with the generation of a chorus of similar tones at selected musical pitches.

2. Description of the Prior Art

Small organs as well as electronic musical instruments designed to tonally imitate theatre organs generally use a tone system that is generically called a "unified" tone system. In a unified instrument a 4-foot stop, or tone, is obtained from its parent 8-foot tone by mechanically, or electrically causing a note to sound one-octave higher than that nominally associated with the actuated keyboard switch. Thus if an 8-foot and 4-foot unified stop combination is selected each keyed note will cause the unison pipe (8-foot pitch) and one in the next higher octave to sound simultaneously. The same general keyboard switching scheme is readily extended to other pitch footages such as the commonly used set of pitches: 16′,5⅓′,8′,4′,2⅔′,2′,13/5′,1′. In this fashion unification has been employed to obtain a fairly large number of stops from a single rank of pipes or a single tone generator in an electronic instrument. One of the main positive attributes of unification in a musical instrument design lies in the economic advantage in lowering cost by extending the use of a single tone generator, or rank of pipes, to a number of stops.

A system for unifying an electronic organ is described in U.S. Pat. No. 3,697,661 entitled "Multiplexed Pitch Generator For Use In A Keyboard Musical Instrument." This patent disclosed a system which operates by employing a conventional time division multiplex of the keyboard switches. Unification is obtained by inserting pulses corresponding to actuated keyswitches into later time slots in the multiplex time scan later than the nominal time slot after time delays depending upon the desired unification pitches.

Digital tone generators such as those described in U.S. Pat. No. 3,315,796 entitled "Digital Organ"; U.S. Pat. No. 3,809,789 entitled "Computor Organ"; and U.S. Pat. No. 4,085,644 entitled "Polyphonic Tone Synthesizer" are generally implemented in a fashion that has the generic name of "straight organ." In these tone generation systems higher pitched (lower footage) stops are obtained by a scheme of harmonic suppression. For example, a 4-foot stop is implemented by using only the even harmonics from the total set of harmonics and suppressing all the odd harmonics. A 2⅔ foot stop is implemented by using only the harmonic sequence 3,6,9,12,15, . . . and suppressing all other harmonics.

The referenced digital tone generators can be unified in a straightforward manner such as one which incorporates a keyboard keying system such as that described in the referenced U.S. Pat. No. 3,697,661 and by adding additional sets of tone generators. Many digital organ systems have a set of 12 tone generators. An additional set of 12 tone generators are required for each unified pitch. The accumulations of these additional sets of tone generators quickly inundates any economic advantage sought by unifying the musical instrument.

A system for producing the sound of unified stops in a digital tone generator is described in U.S. Pat. No. 4,286,491 entitled "Unified Tone Generation In A Polyphonic Tone Synthesizer." In this system a plurality of data words corresponding to the amplitudes of a corresponding number of evenly spaced points defining the waveform of an audio signal composed of a number of unified tones are generated by the combination of three master data sets. The three master data sets are computed separately from stored sets of even and odd harmonic coefficient values. The master data set values are combined using their symmetrical properties and are transferred sequentially to a digital-to-analog converter in repetitive cycles at a rate proportional to the unison pitch of the corresponding keyboard note to produce the tone color of a combination of unified tones.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created by implementing a discrete Fourier transform using a select logic which characterizes the selected output musical sounds or tones. At the end of each one of the sequence of computation cycles, the computed master data set is stored in a main register. The computations are carried out at a fast rate which may be nonsynchronous with any musical frequency.

Following each computation cycle, a transfer cycle is initiated during which the stored master data set is transferred from the main register to preselected members of a multiplicity of tone generators and stored in a note register which is an element of each of the individual tone generators. The output tone generation continues uninterrupted during the computation and transfer cycles.

The select logic is capable of simultaneously generating a full set of unified pitches using only a minimum number of stored harmonic coefficients which are time shared for each setting of the tone switches, or stops. A reduction in the computation cycle time is obtained by only computing non-zero values of the selected harmonic coefficients.

It is an object of the present invention to simultaneously generate a set of unified tones from a minimal set of stored constants that are time shared.

It is a further object of the present invention to decrease the computation time required to compute a set of unified musical tones.

BRIEF DESCRIPTION OF THE DRAWINGS

The detailed description of the invention is made with reference to the accompanying drawings wherein like numerals designated like components in the figures.

DETAILED DESCRIPTION OF THE INVENTION

The present invention is directed toward a flute chorus tone generator in which a set of unified flute tones are generated by time sharing a minimal set of stored constants. The flute chorus tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer to implement the improvements of the present invention or correspond to combinations of several elements appearing in the referenced patent.

Flute tones are characterized by having only a few harmonics. This is true for the commonly used flute tone of the tibia tone class. A flute tibia usually has only two strong harmonic components. The first harmonic is the strongest component and the third harmonic is generally about 20 db less in power in relation to the fundamental, or first harmonic. A typical small organ tonal design may incorporate a flute chorus selected from stops at pitches of 16-foot, $5\frac{1}{3}$-foot, 8-foot, 4-foot and $2\frac{2}{3}$-foot. The relation of the harmonics for the various pitches are shown in the spectra illustrated in FIGS. 1–5.

Figures 1, 2, 3, 4, 5, 6, 7:
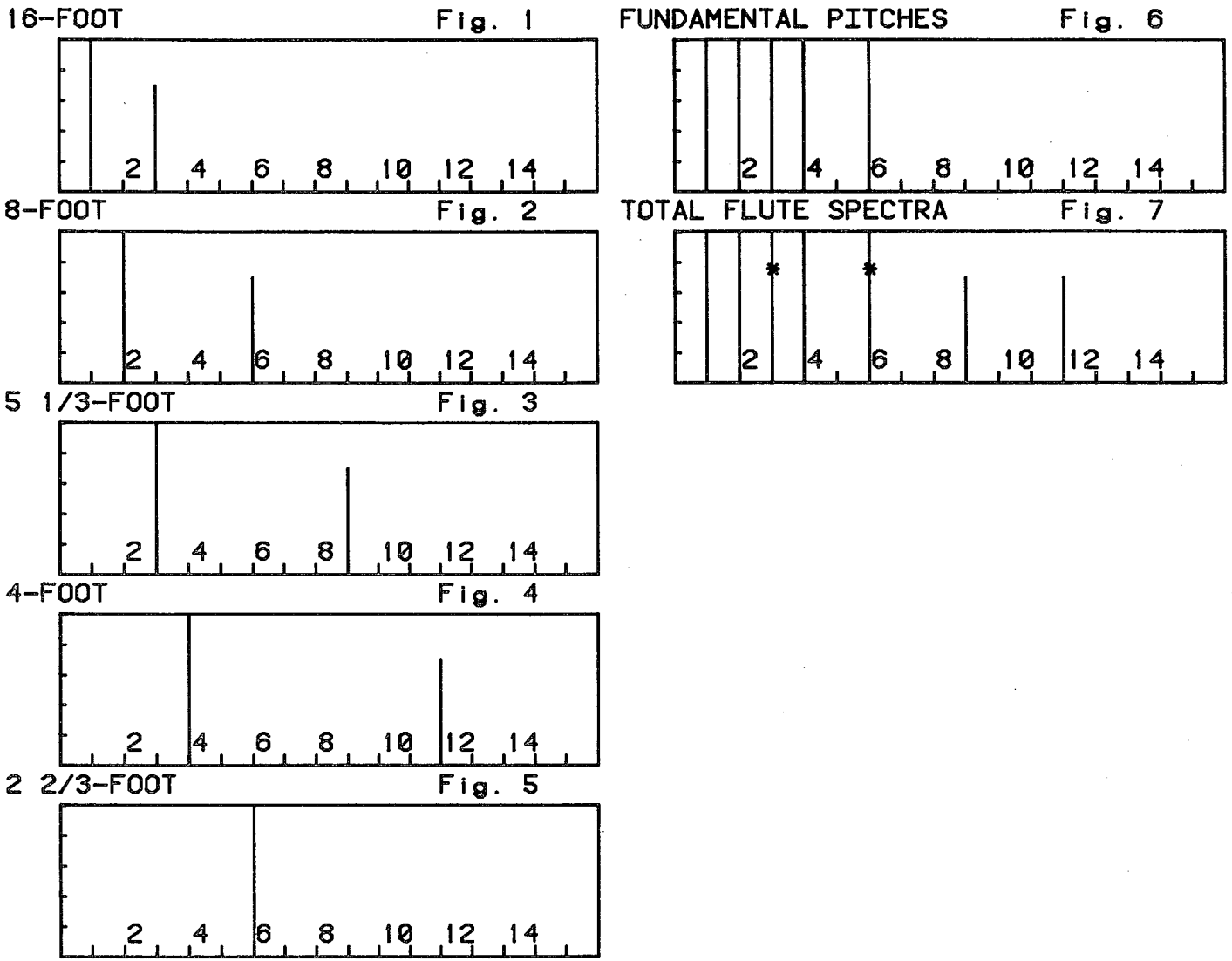
FIG. 1 is the spectra of a 16-foot flute tibia.
FIG. 2 is the spectra of an 8-foot flute tibia.
FIG. 3 is the spectra of a 5⅓-foot flute tibia.
FIG. 4 is the spectra of a 4-foot flute tibia.
FIG. 5 is the spectra of a 2⅔-foot flute tibia.
FIG. 6 is the spectra of the fundamental tones.
FIG. 7 is the combined spectra for a tibia flute chorus.

FIG. 6 illustrates the spectra for only the fundamentals of each member of the flute chorus. FIG. 7 illustrates the combined spectra for the flute chorus. It is noted that only two additional harmonics, the 9th and 12th, are required in addition to the five fundamental harmonics of the 16-foot harmonic sequence. Moreover the 3rd and 6th harmonics, which are marked by an asterisk, are used both as a fundamental as well as a third harmonic for an associated footage of 16-foot pitch and 8-foot pitch respectively. Thus it is observed that the entire flute chorus generator only requires a capability of employing 7 harmonics.

Figure 8:
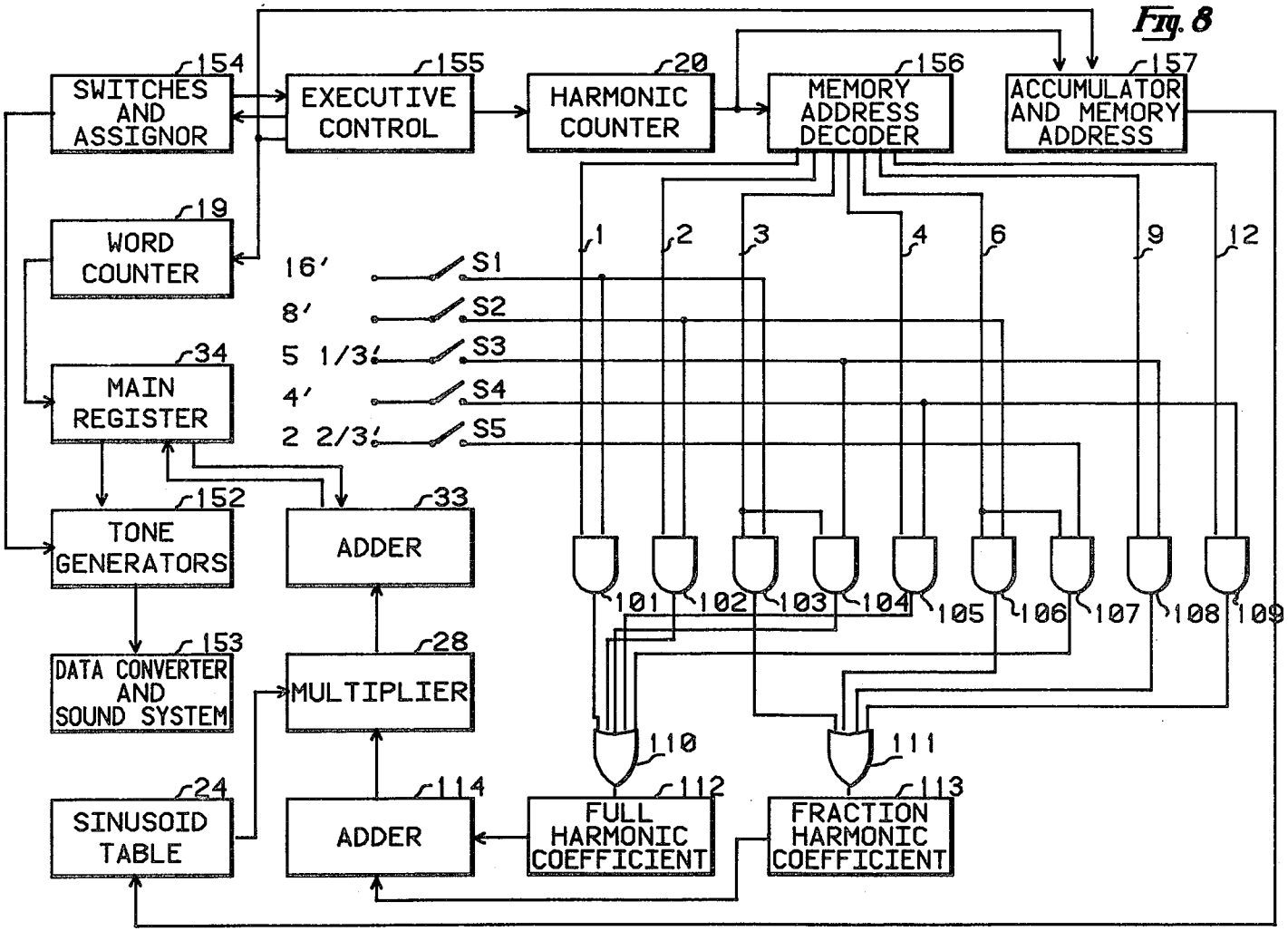
FIG. 8 is a schematic diagram of an embodiment of the invention.

FIG. 8 shows an embodiment of the present invention which is described as a modification and adjunct to the system described in U.S. Pat. No. 4,085,644. As described in the referenced patent, the Polyphonic Tone Synthesizer includes an array of switches. The array is contained in the system block labeled switches and assignor 154 which, for example, correspond to the conventional keyboard linear array of switches for an electronic musical instrument such as an organ. If one or more instrument keys have a switch status change and are actuated ("on" position) on the instrument's keyboard, a note detect and assignor circuit, which is a component of the system block labeled switches and assignor 154, stores the corresponding note information for the actuated keyswitches and assigns one member of the set of tone generators 152 to each actuated keyswitch. A suitable note detect and assignor subsystem is described in U.S. Pat. No. 4,022,098 which is hereby incorporated by reference.

When one or more keyswitches on the keyboards have been actuated, the executive control 155 initiates a sequence of computation cycles. During each computation cycle, a master data set consisting of 32 data words is computed in a manner described below and stored in the main register 34. The 32 data words in the master data set are generated using the harmonic coefficients furnished to the adder 114 in response to the switch state status of the tone switches, or stops, S1–S5. The 32 data words in the master data set correspond to the amplitudes of 32 equally spaced points of one cycle of the audio waveform for the musical tone produced by the tone generators 152. The general rule is that the maximum number of harmonics in the audio tone spectra is no more than one-half of the number of data points in one complete waveshaped cycle. Therefore, a master data set comprising 32 data words corresponds to a maximum of 16 harmonics which suffices to generate a flute chorus.

At the completion of each computation cycle in the sequence of computation cycles, a transfer cycle is initiated during which the master data set residing in the main register 34 is transferred to note registers which are elements of each member of the set of tone generators contained in the system block labeled tone generators 152. These note registers store the 32 data words which correspond to one complete cycle of a preselected musical tone corresponding to the switch states of the tone switches S1–S5. The data words stored in the note registers are read out sequentially and repetitively and transferred to a digital-to-analog converter which converts the digital data words into an analog musical waveshape. The digital-to-analog converter is contained in the system block labeled data conversion and sound system 153. The musical waveshape is transformed into an audible sound by means of a sound system consisting of a conventional amplifier and speaker subsystem which are also contained in the system block labeled data conversion and sound system 153. The stored data is read out of each note register at an address advance rate corresponding to the fundamental frequency of the note corresponding to the actuated keyswitch to which a tone generator has been assigned.

As described in the referenced U.S. Pat. No. 4,085,644 it is desirable to be able to continuously recompute and store the generated master data set during a sequence of computation cycles and to load this data into the note registers while the actuated keys remain depressed on the keyboards. This system function is accomplished without interrupting the flow of data points to the digital-to-analog converter at the read-out clock rates.

In the manner described in the referenced U.S. Pat. No. 4,085,644 the harmonic counter 20 is initialized at the start of each computation cycle. Each time the word counter 19 is incremented so that it returns to its initial state because of its modulo counting implementation a signal is provided which increments the count state of the harmonic counter 20. The word counter 19 is implemented to count modulo 32 which is the number of data words in the master data set which is generated and stored in the main register 34. The harmonic counter 20 is implemented to count modulo 16. This number corresponds to the maximum number of harmonics consistent with a master data set comprising 32 data words.

At the start of each computation cycle, the contents of the accumulator contained in the accumulator and memory address 156 is initialized to a zero value. Each time that the word counter 19 is reset to its initial value, the accumulator is reset to a zero value. Each time that the word counter 19 is incremented, the accumulator adds the current count state of the harmonic counter 20 to the sum contained in the accumulator.

The content of the accumulator in the accumulator and memory address 157 is used to address out sinusoid values from the sinusoid table 24. The sinusoid table 24 is implemented as a read only memory storing values of the trigonometric function sin $(2\pi\phi/32)$ for $0 \leqq \phi \leqq 32$ at intervals of D where D is a resolution constant.

The trigonometric values read out from the sinusoid table 24 are provided as one of the input data values to the multiplier 28.

The memory address decoder 156 decodes the binary count states of the harmonic counter into a time sequence of decimal integer states which are outputs on the 7 lines shown in FIG. 8. Only the 7 count states are used in the select logic and the remaining count states of the harmonic counter are ignored by the memory address decoder 156.

The array of AND-gates 101–109 are used to select harmonic signals present on the seven output signal lines from the memory address decoder 156 in response to the actuation of the five tone switches S1–S5. For example, suppose that the 16-foot tone switch S1 is closed ("on" actuated position). In this case the AND-gate 101 will transfer the first harmonic signal to the OR-gate 110 and the third harmonic signal will be transferred, when it occurs at a later time, to the OR-gate 111 via AND-gate 103.

The set of AND-gates 101–109 and the two OR-gates 110 and 111 serve to provide the select signals corresponding to the harmonic spectra curves shown in FIGS. 1–7.

The zero db harmonic coefficient constant is stored in the full harmonic coefficient 112. The −20 db harmonic coefficient constant is stored in the fraction harmonic coefficient 113. These constants are selected and transferred to the adder 114 in response to the signals provided by the OR-gates 110 and 111. The output of the adder 114 is furnished as the second data input to the multiplier 28.

The contents of the main register 34 are initialized at the start of a computation. At each time that the word counter 19 is incremented, the contents of the main register 34 corresponding to the count state of the word counter 19 is read out and furnished as one input to the adder 33. The sum of the two inputs to the adder 33 are stored in the main register 34 at a location equal to, or corresponding to, the count state of the word counter 19.

After the word counter 19 has been cycled for 16 complete count cycles of 32 counts each, the main register 34 will contain the master data set having a waveshape corresponding to the actuation of the tone switches S1–S5.

Since only 7 harmonics are required to generate any combination of the five voices comprising the tibia flute chorus a time saving can be attained by an appropriate implementation of the harmonic counter 20. One implementation is to use the technique of inhibiting count states so that only the states corresponding to the decimal integers 1,2,3,4,6,9, and 12 can exist. All other states are eliminated by logic gates. An alternative implementation is to have the harmonic counter designed to count modulo 7. The count state is then used to address a memory so that the number sequence 1,2,3,4,6,9,12 is read out in response to the count state of the harmonic counter. This number sequence serves as the data input to the memory address decoder 156 and the accumulator and memory address 157. If one of these limited harmonic sequence generators are used then the word counter 19 is only cycled 7 complete cycles during a computation time cycle.

Instead of a −20 db harmonic coefficient, the full harmonic coefficient 112 and the fraction harmonic coefficient 113 can contain other ratios of harmonic coefficients to provide a variety of tibia-like flute tones.

Figure 16:
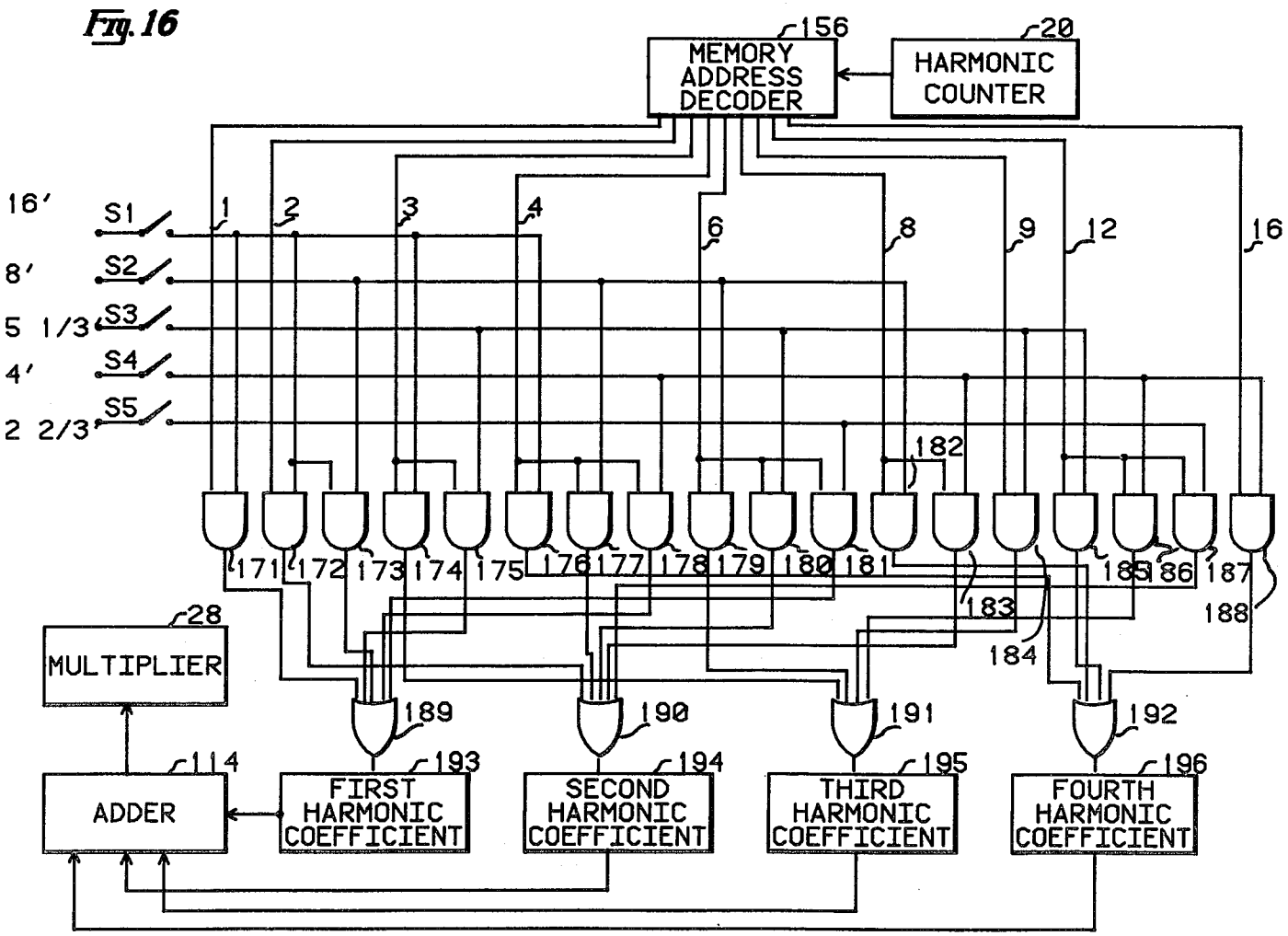
FIG. 16 is a schematic diagram of an alternate embodiment of the invention.

The simplicity and computational speed attributes of the basic system shown in FIG. 8 can readily be extended to generate flute choruses in which the individual tones are not limited to only a first and third harmonic. FIG. 16 illustrates such an extension in which a flute chorus is generated with component flute tones having four harmonics.

FIGS. 9–13 illustrate the harmonic spectra for each of the five pitches available by actuating the tone switches S1–S5. For simplicity, all of the harmonics are shown to have equal strength. In practice one would select various different values for each of the four harmonic coefficients.

Figures 9, 10, 11, 12, 13, 14, 15:
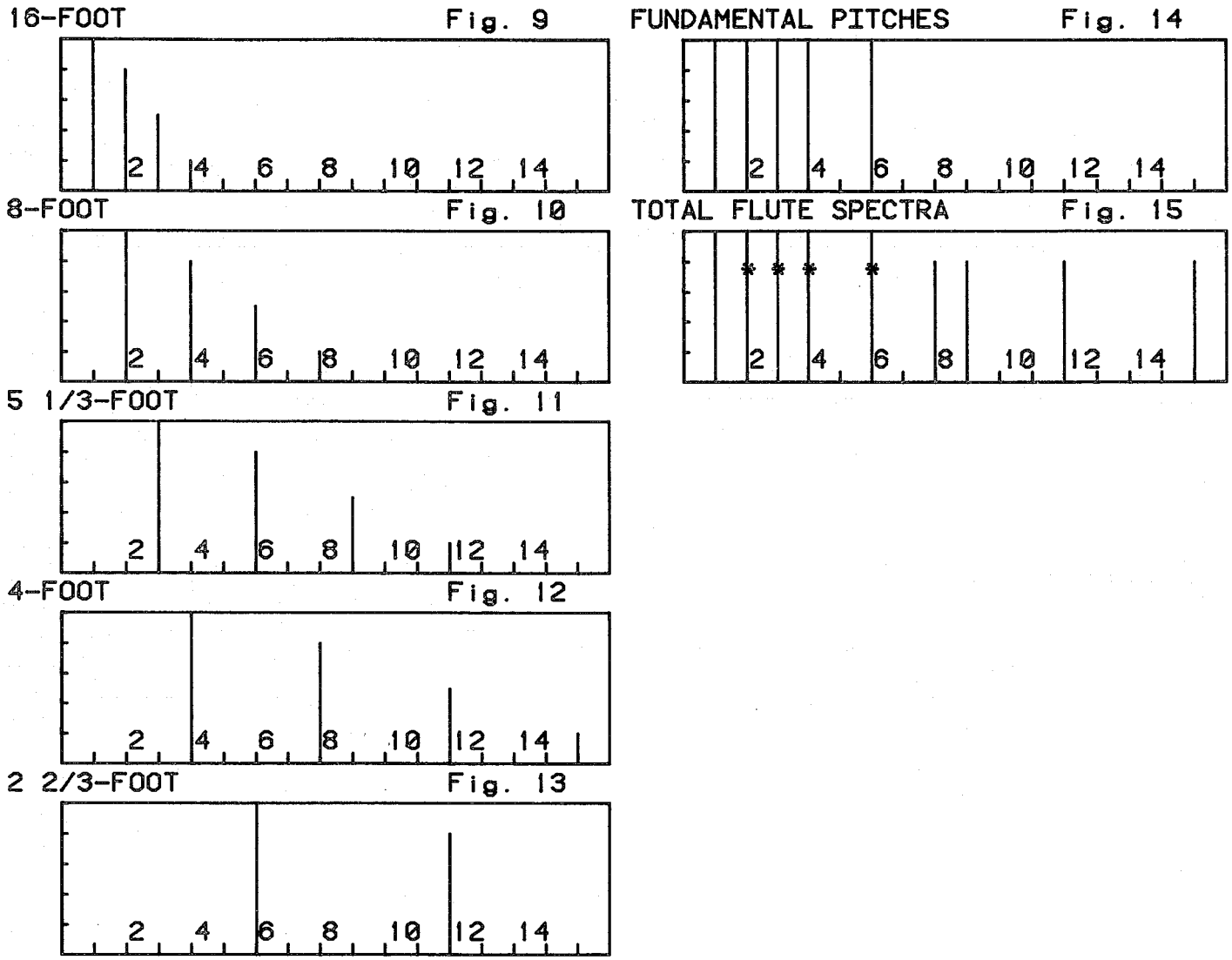
FIG. 9 is the spectra of a 16-foot flute tone.
FIG. 10 is the spectra of an 8-foot flute tone.
FIG. 11 is the spectra of a 5⅓-foot flute tone.
FIG. 12 is the spectra of a 4-foot flute tone.
FIG. 13 is the spectra of a $2\frac{2}{3}$-foot flute tone.
FIG. 14 is the spectra of the fundamental tones for a flute chorus.
FIG. 15 is the combined spectra for a flute chorus.

FIG. 14 shows the spectra consisting of only the five fundamental harmonics of the entire flute chorus of five tones. FIG. 15 illustrates the combined spectra of all the harmonics for the entire flute chorus. It is noted that only 9 harmonics are required for the total combination of the five component tones. The harmonic spectra marked with an asterisk denote those harmonics that are shared with the fundamental component of at least one element of the flute chorus.

FIG. 16 shows the modification of the system shown in FIG. 8 designed to create a unified flute chorus in which each component tone of the flute chorus is generated with four harmonics. The exception for four harmonics is the 2 $\frac{2}{3}$-foot pitch which because of the illustrative design choice of a maximum of 16 harmonics, limits this tone to only two harmonics.

The set of AND-gates 171–188 serve to select the harmonic signals from the decoded lines emanating from the memory address decoder 156 in response to the actuated states of the tone switches S1–S5. The four stored harmonic constants are selected in response to the signals transferred by the set of OR-gates 189–192. The combination of the AND-gates 171–188 and the OR-gates 189–192 implement a select mechanism to produce a unified flute chorus corresponding to the spectra shown in FIGS. 9–13.

It is noted that the flute chorus generator operates by generating a harmonic sequence based upon a 16-foot pitch as the fundamental. This choice is dictated by the usual inclusion of the 5$\frac{1}{3}$-foot pitch whose fundamental is the third harmonic of the 16-foot fundamental pitch. If an 8-foot pitch were used as the fundamental of the harmonic sequence, then an examination of FIGS. 9–13 or FIGS. 1–5 indicates that some special arrangement would have to be implemented to generate the special harmonic sequence required by the 5$\frac{5}{8}$-foot pitch.

The flute chorus generator of the present invention generates a unified tone chorus but does not have a characteristic negative attribute that occurs in the conventional unified musical instrument design. This negative, or undesirable, attribute is one of "missing" notes. Suppose that in a unified pipe organ an 8-foot and a 4-foot flute stop are both actuated. If the musician plays a note such as $C_4$, then both $C_4$ and $C_5$ will sound simultaneously. Now if the player now plays $C_5$ while still playing $C_4$, then the pipes corresponding to $C_4$, $C_5$ and $C_6$ will sound. However, since $C_5$ was already sounded, the aural result is that a note is missing. In the present arrangement if an 8-foot and 4-foot flute tibia tone switch is simultaneously actuated, the master data set will be generated with the harmonic sequence: 2,4,6,12. This sequence corresponds to the sum of an 8-foot and 4-foot tone and the phenomena of missing notes does not occur.

If the flute chorus is generated with four harmonics, then the combination of an 8-foot flute and a 4-foot flute results in a master data set computed from the combined harmonic series: 2,4,6,8,12,16. Because of the adder 114, the 4th and 8th harmonic will add to help overcome the missing note phenomena and to produce a combination tone which more definitively represents the addition of two component tones.

The present invention can be combined with a variety of tone generators which operate by employing a discrete Fourier-type transform using selected sets of harmonic coefficients. One such tone generator system is described in U.S. Pat. No. 3,809,789 entitled "Computor Organ." This patent is hereby incorporated by reference.

Figure 17:
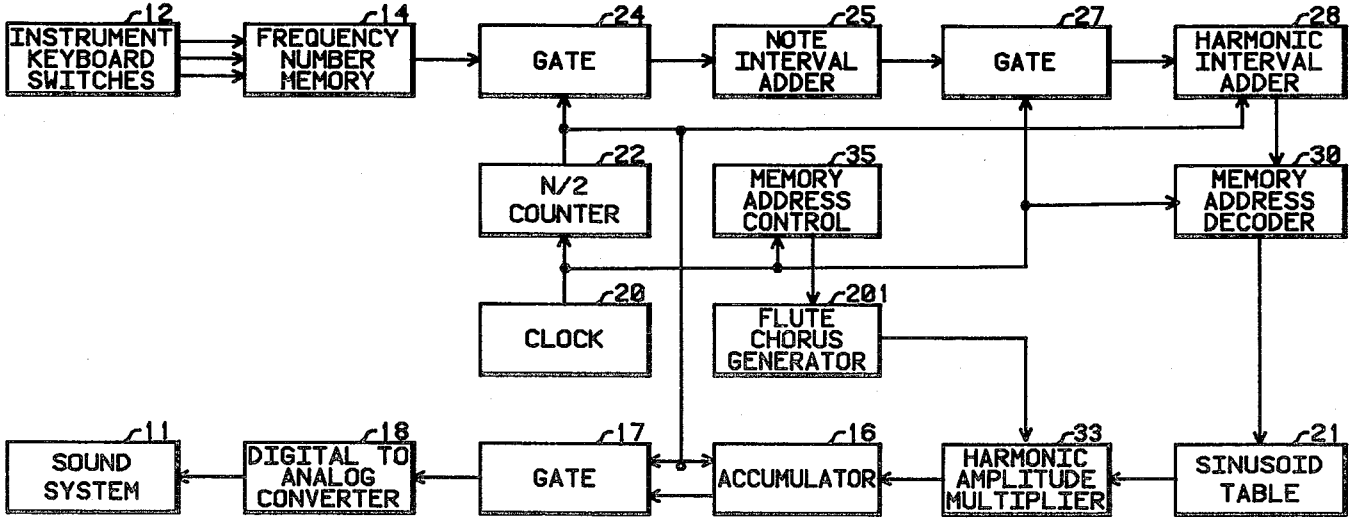
FIG. 17 is a schematic diagram of a flute chorus generator for a computor organ system.

FIG. 17 illustrates a tone generator system which incorporates the present invention into the Computor Organ described in the referenced patent. The block labeled flute chorus generator 201 replaces the block labeled harmonic coefficient memory 15 shown in FIG. 1 of the referenced patent.

Figure 18:
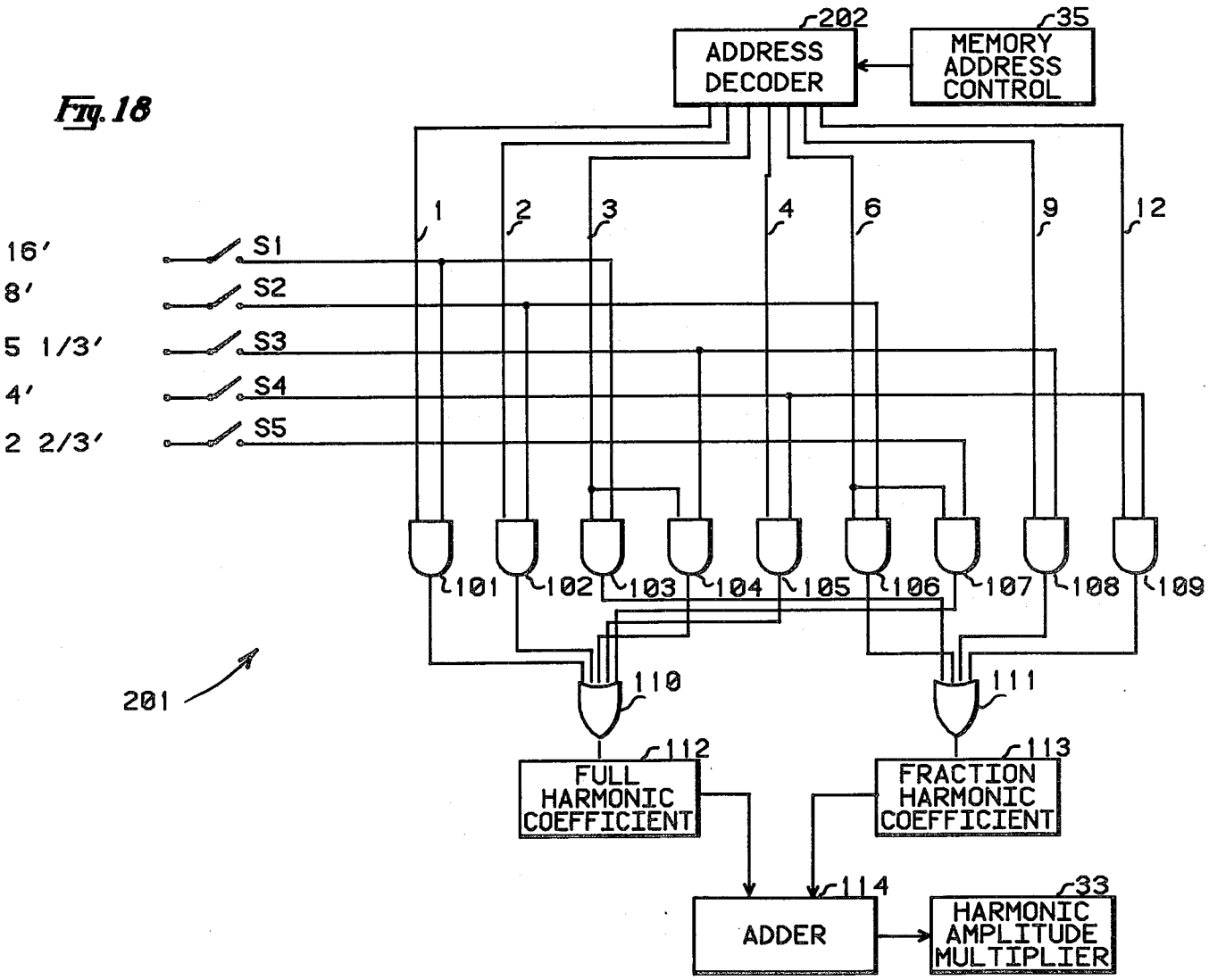
FIG. 18 is a schematic diagram of the flute chorus generator 201.

FIG. 18 illustrates the detailed logic of the flute generator 201 implemented to generate a tibia flute chorus in which each component voice comprises a first and a third harmonic component. The contents of the memory address control 35 are decoded in a time sequence onto seven harmonic state lines by means of the address decoder 202. Only the harmonic states corresponding to the harmonic number sequence 1,2,3,4,6,9, and 12 are decoded. The remaining harmonics 5,7,8,10,11,13,14 and 16 are ignored and are not decoded since they will not contribute to the tibia flute chorus. The remainder of the logic shown in FIG. 18 operates in a manner previously described for a similar logic shown in FIG. 8.

A closure of a keyswitch contained in the instrument keyboard switches 12 causes a corresponding frequency number to be accessed out from the frequency number memory 14. The accessed frequency number is added repetitively to the contents of the note interval adder 25. The content of the note interval adder 25 specifies the sample point at which a wave shape amplitude is calculated. For each sample point, the amplitudes of a number of harmonic components are calculated individually by multiplying harmonic coefficients provided by the flute chorus generator 201 by a trigonometric sinusoid value read out from the sinusoid table 21 by the memory address decoder 30. The harmonic component amplitudes are summed algebraically in the accumulator 16 to obtain the net amplitude at a sample point. The sample point amplitudes are converted into an analog signal by means of the digital-to-analog converter 18.

I claim:

1. In a keyboard musical instrument having a number of tone generators, in which a plurality of data words corresponding to the amplitudes of points defining the waveform of a musical tone are computed and transferred sequentially to a digital-to-analog converter to be converted into musical waveshapes, apparatus for simultaneously generating a chorus of similar tones each at a preselected tone footage comprising;

a plurality of tone switches each corresponding to a tone footage, a coefficient memory for storing a set of harmonic coefficient values, a harmonic number generating means whereby a sequence of harmonic numbers is generated and wherein said sequence is equal to the number of harmonic coefficient values comprising said set of harmonic coefficient values, a first address decoder means responsive to said sequence of harmonic numbers whereby a subsequence of harmonic numbers is generated by selecting prespecified ones of said sequence of harmonic numbers and wherein said subsequence of harmonic numbers is less in number than said set of harmonic coefficient values, a means for computing, responsive to said set of harmonic coefficient values, whereby said plurality of data words corresponding to the amplitudes of points defining the waveform of a musical tone are computed, a coefficient select means responsive to the actuation of said plurality of tone switches and responsive to said subsequence of harmonic numbers whereby selected harmonic coefficient values from said set of harmonic coefficient values are read out from said coefficient memory and provided to said means for computing, and a means for producing musical waveshapes from said plurality of data words thereby generating said chorus of similar tones each one at a tone footage corresponding to the actuation of one of said plurality of tone switches.

2. A musical instrument according to claim 1 wherein said plurality of tone switches comprises;

a select signal generation means whereby footage select signals are generated in response to the closure of selected tone switches in said plurality of tone switches.

3. A musical instrument according to claim 2 wherein said means for computing comprises;

a main memory means for storing said plurality of data words computed during each computation cycle in a repetitive sequence of computation cycles, a clock for providing timing signals, a word counter for counting said timing signals modulo the number of said plurality of data words stored in said main memory means.

a harmonic counter incremented each time said word counter returns to its minimal count state, an adder-accumulator means wherein the count state of said harmonic counter is successively added to the contents of an accumulator in response to said timing signals and wherein the content of said accumulator is initialized to a zero value at the start of each said computation cycle, a sinusoid table for storing a plurality of trigonometric sinusoid values, a second address decoder means responsive to the content of said accumulator in said adder-accumulator means for reading out trigonometric sinusoid values from said sinusoid table, a multiplier means for multiplying the trigonometric sinusoid values read out from said sinusoid table by harmonic coefficient values provided by said coefficient select means, and a means for successively summing the output from said multiplier means with values read out from said main memory means in response to the count state of said word counter means and whereby the summed values are stored in said main memory means.

4. A musical instrument according to claim 3 wherein said first address decoder means comprises;

a decoding circuitry means responsive to preselected count states of said harmonic counter whereby said subsequence of harmonic signals are generated on a plurality of harmonic select signal lines.

5. A musical instrument according to claim 4 wherein said coefficient select means comprises;

a harmonic select means responsive to said footage select signals generated by said select signal generation means whereby each said footage select signal causes a sequence of harmonic coefficient select signals to be generated in response to harmonic signals generated on said plurality of harmonic signal lines, and a coefficient addressing means responsive to said harmonic coefficient select signals whereby corresponding harmonic coefficient values are read out from said coefficient memory and provided to said means for computing.

6. In a keyboard musical instrument in which a plurality of data words are computed at regular time intervals corresponding to the combination of a number of tone generators are computed and converted into musical waveshapes, apparatus for simultaneously generating a chorus of similar tones each at a preselected tone footage comprising;

a plurality of tone switches each corresponding to a tone footage, a coefficient memory for storing a set of harmonic coefficient values, a harmonic number generating means whereby a sequence of harmonic numbers is generated and wherein said sequence is equal to the number of harmonic coefficient values comprising said set of harmonic coefficient values, a first address decoder means responsive to said sequence of harmonic numbers whereby a subsequence of harmonic numbers is generated by selecting prespecified ones of said sequence of harmonic signals and wherein said subsequence of harmonic numbers is less in number than said set of harmonic coefficient values, a harmonic select means whereby members of said subsequence of harmonic numbers are selected in response to the actuation of members of said plurality of tone switches, a first addressing means whereby harmonic coefficient values are read out from said coefficient memory in response to said selected members of said subsequence of harmonic numbers, a computing means responsive to harmonic coefficient values read out from said coefficient memory for computing at regular time intervals a sequence of data words each of which corresponds to a combination of a number of tone generators, and a means for producing musical waveshapes from said sequence of data words thereby generating said chorus of similar tones each one at a tone footage corresponding to the actuation of one of said plurality of tone switches.

7. A musical instrument according to claim 6 wherein said plurality of tone switches comprises a select signal generation means whereby footage select signals are generated in response to the closure of selected tone switches in said plurality of tone switches.

8. A musical instrument according to claim 7 wherein said computing means comprises;

a means for obtaining a frequency number, a note interval adder wherein said frequency number is successively added to the sum previously contained in said note interval adder, a harmonic interval adder cleared before each of the computation of one of said sequence of data words wherein the content of said note interval adder is added to the contents previously in said harmonic interval adder, a sinusoid table for storing a plurality of trigonometric sinusoid values, a second address decoder means responsive to the contents of said harmonic interval adder for reading out trigonometric sinusoid values from said sinusoid table, a multiplier means for multiplying the trigonometric sinusoid values read out from said sinusoid table by harmonic coefficient values provided by said coefficient select means, and a means for successively summing the output from said multiplier means thereby producing each one of said sequence of data words.

9. A musical instrument according to claim 8 wherein said first address decoder means comprises a decoding circuitry means responsive to preselected values of the content of said harmonic interval adder whereby said subsequence of harmonic signals are generated on a plurality of harmonic select signal lines.

10. A musical instrument according to claim 9 wherein said coefficient select means comprises;

a harmonic select means responsive to said footage select signals generated by said select signal generation means whereby each said footage signal causes a sequence of harmonic coefficient select signals to be generated in response to harmonic signals generated on said plurality of harmonic signal lines, and a coefficient addressing means responsive to said harmonic coefficient select signals whereby corresponding harmonic coefficient values are read out from said coefficient memory and provided to said computing means.

* * * * *